US005470063A

United States Patent [19]

Fisher

[11] Patent Number: 5,470,063

[45] Date of Patent: Nov. 28, 1995

[54] ADJUSTABLE GOLF CLUB PUTTER

[76] Inventor: Dale P. Fisher, 21072 Marino La., Huntington Beach, Calif. 92646

[21] Appl. No.: 312,533

[22] Filed: Sep. 26, 1994

[51] Int. Cl.[6] ..... A63B 53/02

[52] U.S. Cl. ..... 273/80.1; 273/80.2; 273/162 F; 273/167 G; 273/193 B

[58] Field of Search ..... 273/80.1, 80.2, 273/81.3, 80 R, 80 C, 167 G, 193 B, 32 B, 162 F

[56] References Cited

U.S. PATENT DOCUMENTS

| | | | |
|---|---|---|---|
| 1,137,457 | 4/1915 | Breitenbaugh | 273/79 |
| 2,091,794 | 8/1937 | Pester | 273/79 |
| 2,107,983 | 2/1938 | Hamilton | 273/81.2 |
| 2,217,338 | 10/1940 | Fuller | 273/79 |
| 2,495,444 | 1/1950 | Chamberlain | 273/79 |
| 2,847,219 | 8/1958 | Shoemaker et al. | 273/79 |
| 3,102,726 | 9/1963 | Barrett | 273/80.1 X |
| 3,214,169 | 10/1965 | Rupnow | 273/80.1 X |
| 3,214,170 | 10/1965 | Warnock | 273/80.1 |
| 3,539,185 | 11/1970 | Andis | 273/79 |
| 3,840,231 | 10/1974 | Moore | 273/79 |
| 4,736,951 | 4/1988 | Grant | 273/80.1 X |
| 4,799,684 | 1/1989 | Rango | 273/32 B X |
| 5,244,205 | 9/1993 | Melanson | 273/79 |
| 5,282,619 | 2/1994 | Napolitano | 273/81.2 X |
| 5,320,346 | 6/1994 | Phillips | 273/80.1 X |

*Primary Examiner*—William H. Grieb
*Attorney, Agent, or Firm*—Leonard Tachner

[57] ABSTRACT

An adjustable putter having an elongated straight shaft terminating in an adjustable gear linkage which mates with a corresponding adjustable gear linkage which is affixed to a hosel, which is in turn connected to a putter head, thereby providing adjustment in a plane which is parallel to the hitting face of the putter head. Such an adjustability feature enables the golfer to vary the angle of the shaft relative to the putter head, while complying with golf regulations such as those disseminated by the U.S. Golf Association. In a preferred embodiment hereof, a tool for permitting the adjustment of the putter is stored in the top of the gripping portion of the shaft.

4 Claims, 4 Drawing Sheets

ADJUSTABLE GOLF CLUB PUTTER

BACKGROUND OF THE INVENTION

1. Field of the Invention

The present invention relates generally to the field of golf club putters and more specifically a golf club putter in which the angle of the shaft with respect to the head and hosel is adjustable over a preselected range by means of a linkage device comprising an adjustment gear which may be used to interconnect a variety of different shafts to a variety of different putter heads and hosels.

2. Prior Art

The following patents disclose subject matter which may be considered relevant to the present invention:

U.S. Pat. No. 2,495,444 Chamberlain
U.S. Pat. No. 2,217,338 Fuller
U.S. Pat. No. 2,847,219 Shoemaker
U.S. Pat. No. 3,840,231 Moore
U.S. Pat. No. 4,736,951 Grant
U.S. Pat. No. 5,244,205 Melanson
U.S. Pat. No. 2,091,794 Pester
U.S. Pat. No. 5,320,346 Phillips
U.S. Pat. No. 3,539,185 Andis
U.S. Pat. No. 3,663,019 Palotsee
U.S. Pat. No. 3,214,170 Warnock
U.S. Pat. No. 3,214,169 Rupnow
U.S. Pat. No. 3,102,726 Barrett
U.S. Pat. No. 2,107,983 Hamilton
U.S. Pat. No. 5,282,619 Napolitano Of the foregoing patents, the one that appears to be the most relevant to the present invention is U.S. Pat. No. 3,663,019 to Palotsee which discloses a golf putter having a telescoping shaft and a swivel connection permitting the upper portions of the shaft and grip to be angled relative to the main portion of the shaft and putter head wherein the upper portion of the shaft can be made to pivot in a plane parallel to the ball striking face as is done in the present invention. Unfortunately, the disclosure by Palotsee relates to an adjustable golf putter which suffers from a number of disadvantages. One such disadvantage is the apparent difficulty of adjusting the shaft portions relative to one another without the use of a special tool that would have to be carried separately by the golfer during play in order to make adjustments during the game. Another disadvantage thereof is the fact that the angular adjustment of the shaft as noted in the aforementioned patent is accomplished at the upper end thereof, near the grip, wherein for most adjustment positions, the plane of the upper portion of the shaft, does not intersect the putter head, thereby making it more difficult for the golfer to accurately control the putter to obtain the direction of ball roll that he wishes in order to putt the ball precisely in the direction of the hole. Perhaps the most significant disadvantage of the aforementioned prior art patent is the fact that the shaft thereof has to be unique in all respects, thus making it impossible or at least impractical to change shafts or putter heads and alternatively making it necessary to buy an entirely new putter in the event that the shaft or head is damaged or the user otherwise wishes to alter either such component. Another significant disadvantage of the aforementioned prior art patent is the unusual configuration and complex structure of the shaft adjustment mechanism thereof, which raises questions in regard to the expense of manufacture, the cost effectiveness to the consumer and the overriding question of whether such complex and unusual structure could receive approval by the U.S.G.A. or other official golf agencies which rule on the question of what can be used as a golf club in tournament play.

Thus, there is, despite the prior art, a continuing need for an adjustable golf club putter, allowing the shaft to be adjusted along a pivot in a plane parallel to the ball striking face, but in a simple configuration which can be made relatively low cost, which can receive the approval of the U.S.G.A. or other governing bodies in the golf industry, which provides a straight, elongated shaft which allows the user to have conventional grip and control of the putter and which is likely to lead to commercial success by permitting the golfer to make adjustments during the game without requiring the golfer to carry separately from the club, special tools for making such an adjustment.

SUMMARY OF THE INVENTION

The present invention meets the aforementioned need by providing an adjustable golf putter having a standard elongated shaft connectable to the hosel of a golf putter head by means of an adjustment gear type linkage. The linkage comprises a shaft gear and a hosel gear, both having a plurality of fine gear teeth designed to permit firm, mutual engagement which may be secured by means of a bolt, preferably a counter-sunk allen type bolt which may be loosened or tightened by means of an allen wrench tool which is secured in the golf club grip in an unobtrusive manner.

A number of alternative embodiments of the invention are shown herein. In some of those embodiments, the gear linkage mechanism is identical, but the hosel which is affixed to the putter head is provided in a variety of different lengths, depending upon the preference of the golfer. In yet another embodiment which is significantly different from the aforementioned embodiments, the gear linkage is adapted to connect to a shaft and to a hosel by either screw thread or press fit engagement therewith to permit easy removal of the linkage therefrom, thus allowing the user to replace the shaft or replace the hosel and putter head. This permits one to substitute new hosels or shafts for damaged ones or to provide different materials or physical configurations of the shafts and hosel head combinations, depending upon the preference of the user. Still an additional characteristic of the present invention which may be provided in all such embodiments is the ability to remove the hosel from the head and reconnect it whereby the head is turned 180 degrees with respect to the gear linkage, thus enabling the putter of the present invention to be either a left-handed putter or a right-handed putter. Thus, the present invention overcomes the aforementioned disadvantages of the prior art by providing a full shaft length, a simplified structural configuration including the gear linkage thereof, a versatile, reversible and ornamentally appealing configuration that is more likely to lead to commercial success, as well as approval by the governing agencies in the golf industry.

OBJECTS OF THE INVENTION

It is therefore a principal object of the present invention to provide an adjustable golf putter having a relatively full length shaft of conventional configuration but adapted to attachment to a hosel of a golf club putter head using a gear type linkage which permits swiveling of the putter head relative to the shaft along a plane parallel to the hitting surface of the putter.

It is an additional object of the present invention to provide an adjustable putter head and shaft configuration wherein the adjustability of the invention is achieved by utilizing a wrench adapted to be stored in the golf club itself utilizing uniquely configured vertical and horizontal slots in the grip portion of the putter shaft.

It is still an additional object of the present invention to provide an adjustable putter which in one embodiment is configured to permit replacement of the shaft and/or the putter head and hosel using a separate gear type linkage for interconnecting the shaft and the hosel and adapted for connection to the shaft by being press fit therewith and to the hosel by being threadably engaged therewith.

It is still an additional object of the present invention to provide an adjustable putter having a removable hosel and permitting the head and hosel to be interconnected for reversing the position of the shaft relative to the putter head, whereby a putter may be used by either left-handed or right-handed golfers.

BRIEF DESCRIPTION OF THE DRAWINGS

The aforementioned objects and advantages of the present invention, as well as additional objects and advantages thereof, will be more fully understood hereinafter as a result of a detailed description of preferred embodiments when taken in conjunction with the following drawings in which.

DETAILED DESCRIPTION OF PREFERRED EMBODIMENTS

Figure 1:
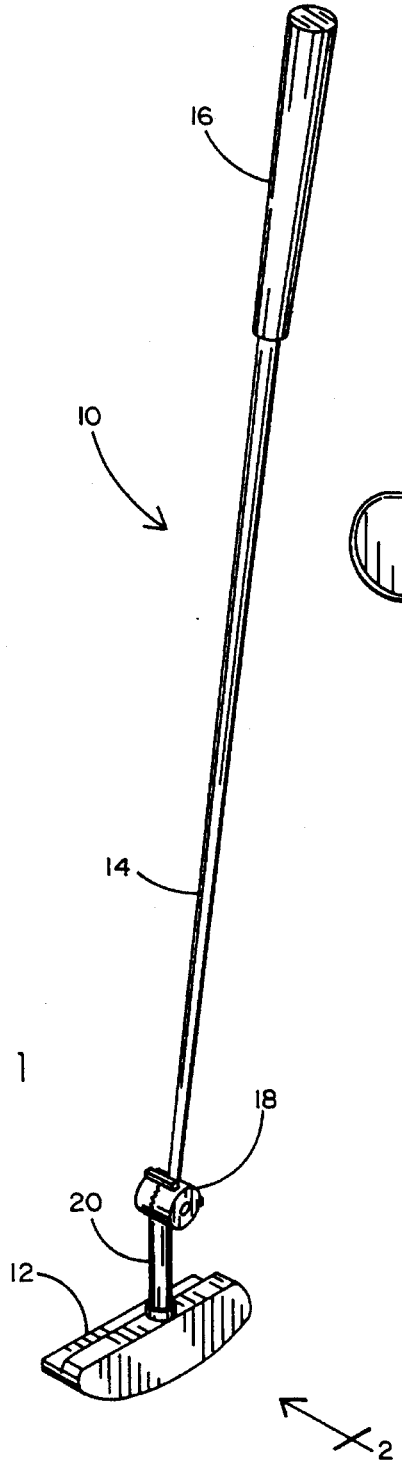
FIG. 1 is a three dimensional view of the present invention shown in its fully assembled configuration.
Figure 2:
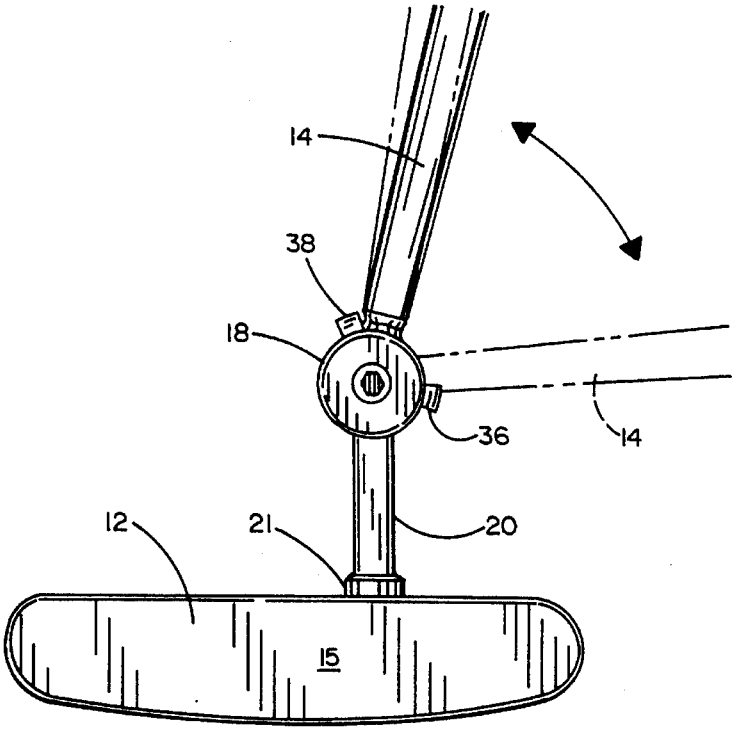
FIG. 2 is an elevational view of the lower portion of the present invention, showing the interconnection of the shaft and the putter head.
Figure 3:
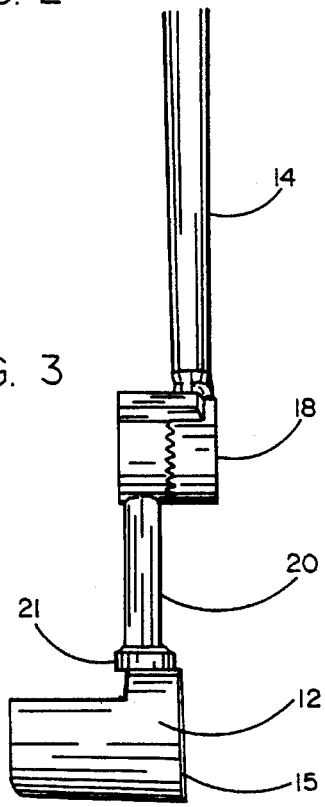
FIG. 3 is a side view of the present invention, showing it in its fully assembled configuration.

Referring now to the accompanying figures, it will be seen that an adjustable putter 10 comprises a putter head 12 and a shaft 14 interconnected by means of an adjustable gear linkage 18 and a hosel 20. It will also be seen that the upward end of the shaft 14 terminates in a grip portion 16. As shown in FIG. 2, the adjustment gear linkage 18 permits the shaft 14 to be swiveled through a preselected angle relative to the hosel 20 and the head 12 in a plane that is substantially parallel to the hitting face 15 of the putter. The extent of the swivel is determined by a pair of stops 36 and 38. As seen in FIGS. 2 and 3, the hosel 20 is preferably connected to the top surface of the putter head 12 with the base 21 of the hosel 20 contacting the putter head and being secured thereto in a manner to be more fully explained hereinafter.

Figure 4:
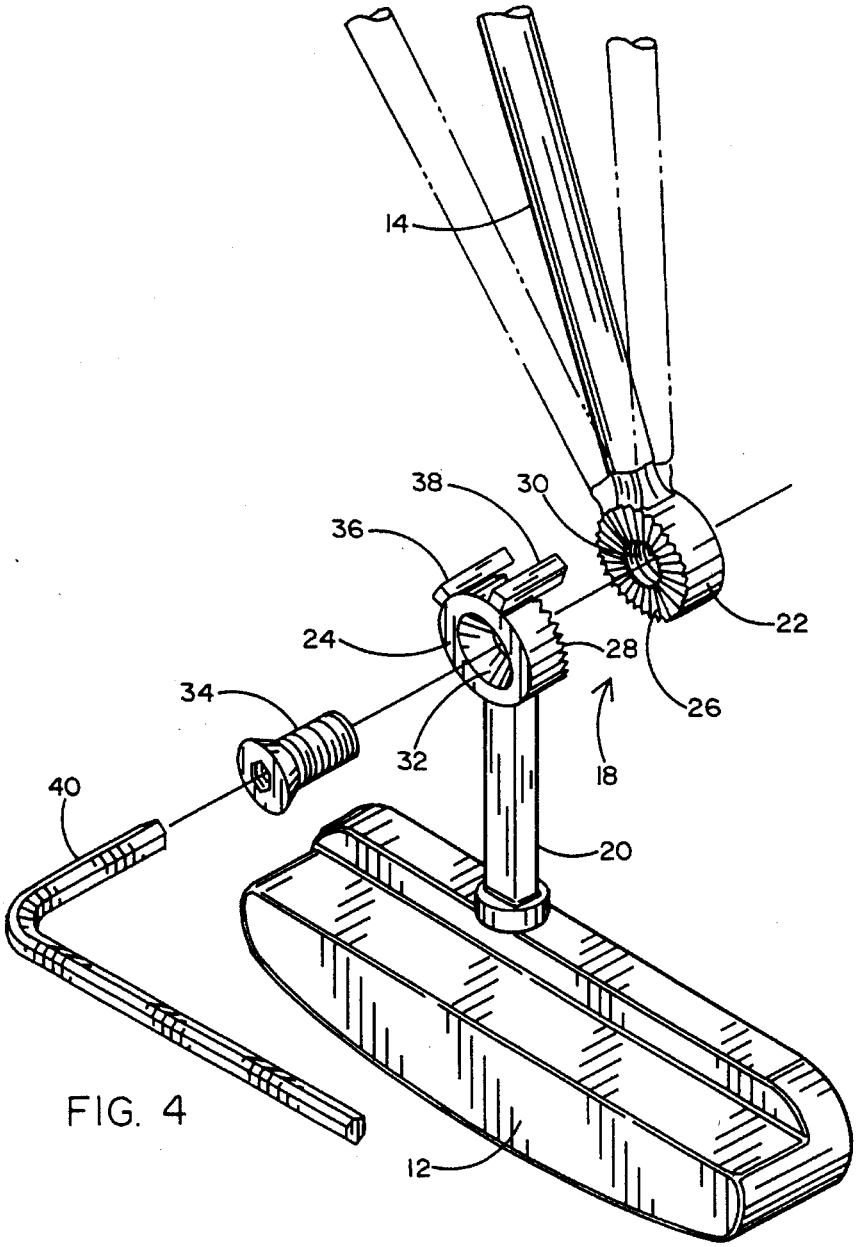
FIG. 4 is a three dimensional view of the lower portion of the present invention showing it in its disassembled configuration.

The manner in which the shaft 14 is interconnected to the hosel 20 and putter head 12 may be better understood hereinafter by reference to FIG. 4. As shown in FIG. 4, the linkage 18 comprises a shaft gear 22, a hosel gear 24 and a bolt 34, such as a counter-sunk allen bolt which is designed to feed through a tapered aperture 32 in the hosel gear 24 and thread into the threaded aperture 30 in the shaft gear 22. It will also be seen that the shaft gear 22 has a plurality of finely configured gear teeth 26. Furthermore, it will be seen that the hosel gear 24 has a like plurality of finely configured gear teeth 28, designed to mate with the gear teeth 26 of the shaft gear 22. It will be understood that the shaft 14 is adjustable relative to the hosel 20 and the putter head 12 when the bolt 34 is adequately loosened by unthreading it from the threaded aperture 30, permitting the teeth 26 and teeth 28 to be disengaged from one another, permitting relative movement between the shaft gear 22 and the hosel gear 24, between the stops 36 and 38, respectively. Furthermore, it will be understood that upon adjustment of the shaft 14 relative to the hosel 20 and the putter head 12, bolt 34 may be retightened, thereby securing shaft gear 22 to hosel gear 24, whereby gear teeth 26 firmly engage gear teeth 28 and thereby firmly affixing the shaft into the selected position between the stops 36 and 38.

Figure 5:
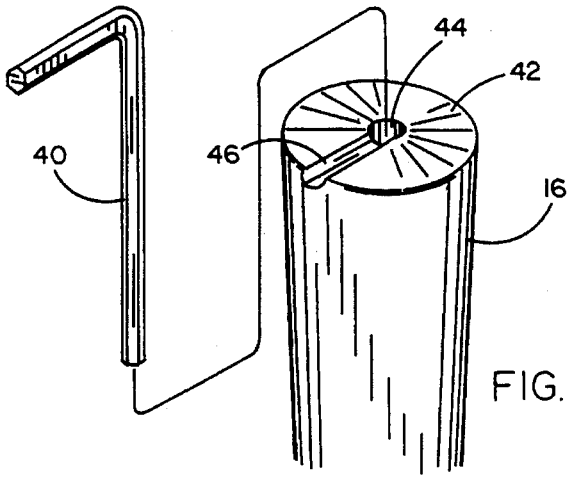
FIG. 5 is a three dimensional view of the grip end portion of the shaft of the present invention and the tool therefore illustrating the manner in which the tool and grip portion thereof can be connected.
Figure 6:
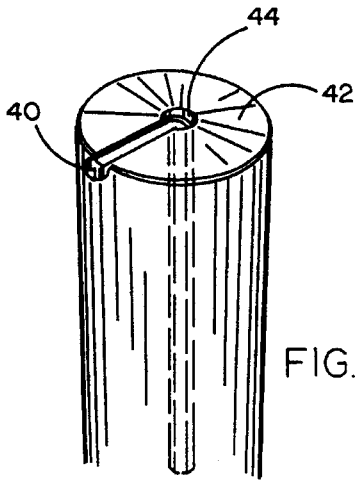
FIG. 6 is a view similar to that of FIG. 5, but showing the tool and grip portion in their interconnected configuration.

Loosening and tightening of the bolt 34 may be preferably accomplished using an allen type wrench 40, shown in FIG. 4. In accordance with the novel feature of the present invention, wrench 40 is preferably stored in the grip portion 16 of the present invention in a manner shown in FIGS. 5 and 6. More specifically, referring to those figures, it will be seen that the shaft top 42 provides a vertical slot 44 and a horizontal slot 46. As seen in FIGS. 6, the vertical slot 44 is designed to accept the elongated portion of wrench 40, while the horizontal slot 46 is designed to accept the foreshortened portion of the wrench 40, thereby permitting unobtrusive storage of the wrench 40 in the adjustable putter 10. In this manner, the wrench 40 is readily accessible during the play of the game for removal from the shaft top 42 for loosening or tightening the bolt 34 to facilitate adjustment of the shaft 14 relative to the hosel 20 and putter head 12.

Figure 7:
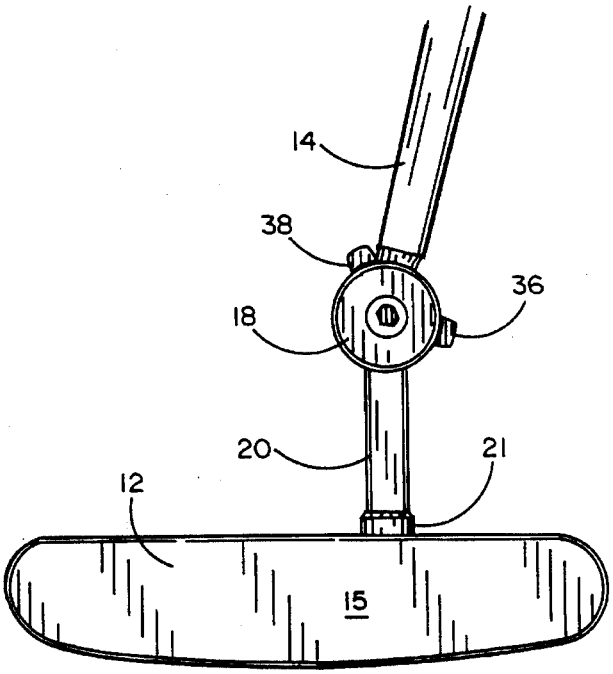
FIG. 7 is a view similar to that of FIG. 2, but illustrating a first of a variety of alternative embodiments of different hosel lengths.
Figure 8:
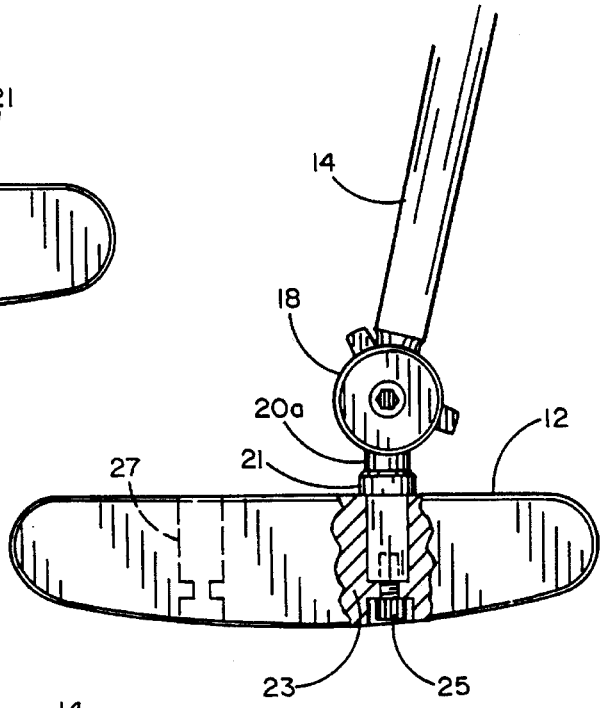
FIG. 8 is a view similar to the view shown in FIG. 7, but illustrating the present invention having a short hosel length.
Figure 9:
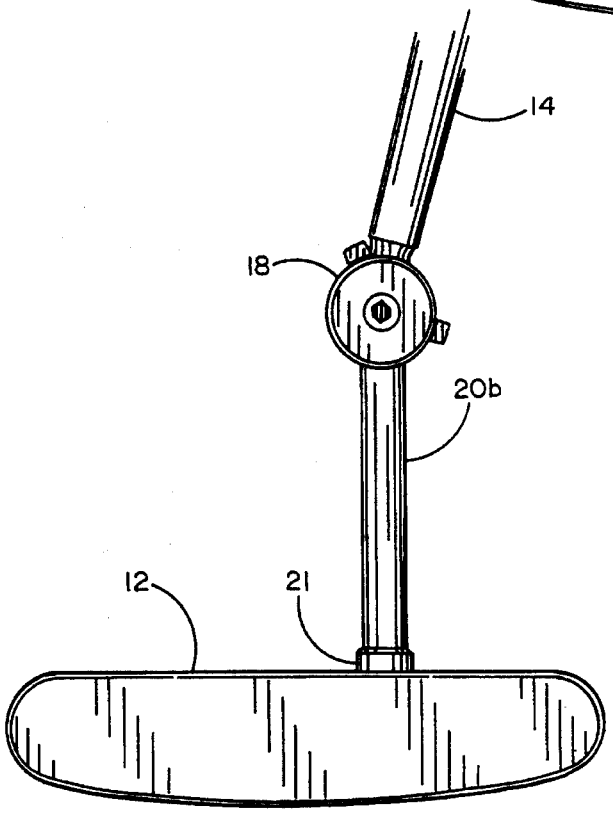
FIG. 9 is a view similar to that of FIG. 7 and 8, but showing an embodiment of the present invention having an elongated hosel length.

FIGS. 7, 8 and 9 illustrate two additional features of the present invention. More specifically, as shown in those figures, the hosel 20 can be readily replaced by a hosel **20*a*, shown in FIG. 8 or a hosel 20*b*, shown in FIG. 9. Hosel 20*a* of FIG. 8 is a short hosel which brings the adjustment gear linkage 18 to a position which is virtually adjacent the top of the putter head 12, thus virtually doing away with the hosel and yet still providing an adjustable linkage between the shaft 14 and the putter head 12. On the other hand, as seen in FIG. 9, hosel 20 may be replaced by a longer hosel 20*b* for those who prefer a putter configuration in which the adjustment gear linkage 18 is positioned further from the putter head 12, while still providing the aforementioned adjustment of the shaft 14 with respect to the putter head through the identical adjustment gear linkage 18**.

Another feature illustrated in FIG. 8 comprises the reversability feature of the present invention. More specifically, it will be seen that there are a pair of apertures 27 in head 12, each designed to receive a square shaped hosel stem 23 having a threaded lower end adapted to receive a bolt 25 as shown in cutaway portion of FIG. 8. Bolt 25 is preferably an allen head type bolt which is adapted to receive the allen wrench 40, shown in FIGS. 4, 5 and 6. Accordingly, the same tool that is carried in the slots of the shaft top 42 can be used to loosen bolt 25 and detach it from the hosel stem 23. This feature permits the hosel, such as hosel 20*a* of FIG. 8, to be withdrawn from the head 12 and instead placed into the other aperture 27, thereby effectively turning a right-handed putter into a left handed putter.

Figure 10:
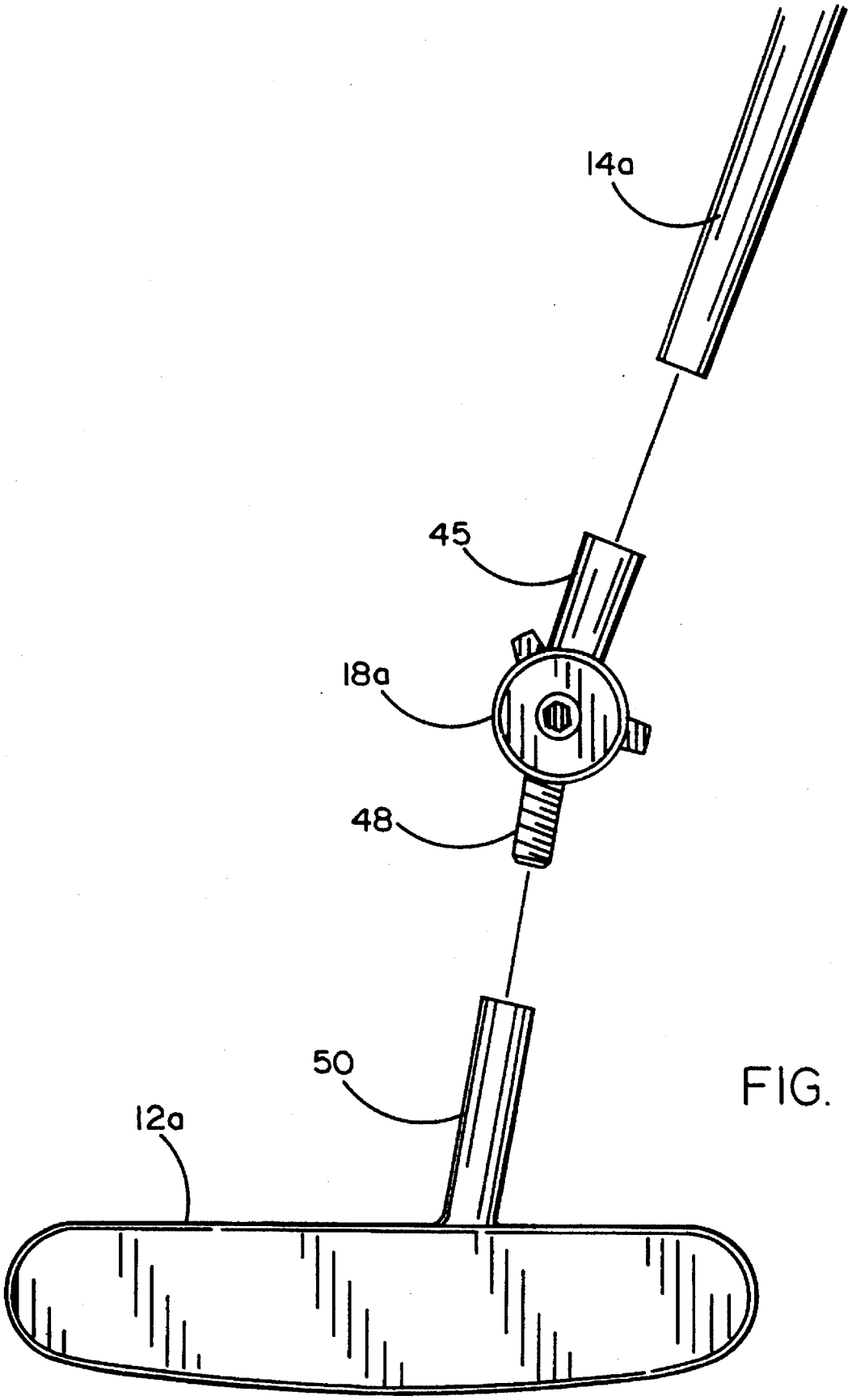
FIG. 10 is an alternative embodiment of the present invention illustrating the adjustment gear linkage in a configuration adapted to be separated from the shaft and from the hosel of a golf club putter head to permit interchanging such components with others, such as a different length shaft or a differently shaped putter head.

Still another embodiment of the present invention is illustrated in FIG. 10. This embodiment varies in configuration from the previous embodiments disclosed in conjunction with FIGS. 1–9 by virtue of the fact that an adjustment gear linkage 18*a* utilizes a tapered hollow stub 45 adapted to receive a shaft 14*a* in press fit engagement therewith. It also comprises a threaded stub 48 which is adapted to be mated in threadable engagement with a hosel 50 which is in turn preferably made integral to the alternative putter head 12*a*. A significant advantage of the alternative embodiment illustrated in FIG. 10 is its flexibility in permitting the replacement of shaft and putter heads with shafts and putter heads of different lengths, such as a different length hosel 50 or a different length shaft 14*a* or alternative configurations of putter heads 12*a*, thereby giving the golfer a greater degree of flexibility in tailoring his putter without having to replace the entire putter.

It will now be understood that what has been disclosed herein comprises an adjustable putter having an elongated straight shaft terminating in an adjustable gear linkage which mates with a corresponding adjustable gear linkage which is affixed to a hosel, which is in turn connected to a putter head, thereby providing adjustment in a plane which is parallel to the hitting face of the putter head. Such an adjustability feature enables the golfer to vary the angle of the shaft relative to the putter head, while complying with golf regulations such as those disseminated by the U.S. Golf Association. A unique configuration of the present invention permits variation in the length of the hosel by substitution of different hosel lengths. It also provides for changes, in the relationship between the shaft and the head to permit configuration as a left handed putter as well as a right handed putter. In a preferred embodiment hereof, a tool for permitting the adjustment of the putter is stored in the top of the gripping portion of the shaft.

Those having skill in the art to which the present invention pertains, will now as a result of the applicants teaching herein, perceive various modifications and additions which may be made to the invention. By way of example, the materials and the precise geometric shapes disclosed herein can be readily altered while still providing the advantages of the invention disclosed herein. Accordingly, all such modifications and additions are deemed to be within the scope of the claims appended hereto and their equivalents.

I claim:

1. An adjustable golf club putter comprising:

a full-length straight shaft having a grip at a first end and a first adjustment gear at a second end;

a putter head having a ball striking face and having a hosel terminating in a second adjustment gear;

said first and second adjustment gears each having a central aperture and a plurality of contiguous radial teeth on an opposed annular face for firm engagement of said gears; and a bolt for selectively securing said gears to one another and for releasing said gears from one another to swivel said shaft relative to said putter head in a plane parallel to said ball striking face.

2. The adjustable putter recited in claim 1 further comprising a tool for tightening and loosening said bolt and means in said grip for storing said tool.

3. The adjustable putter recited in claim 2 wherein said tool is a multi-sided wrench and wherein said storing means is at least one slot in said grip for receiving said wrench.

4. The adjustable putter recited in claim 1 wherein said putter head has two apertures, each such aperture being configured for receiving said hosel, said hosel being configured for insertion to either of said two putter head apertures for configuring said putter for either of right-hand and left-hand use.

* * * * *